United States Patent [19]

Duryea et al.

[11] Patent Number: 4,916,911

[45] Date of Patent: Apr. 17, 1990

[54] SNOWMAKING PROCESS AND APPARATUS

[75] Inventors: George R. Duryea, Buffalo; Michael S. Holden, Williamsville, both of N.Y.

[73] Assignee: Dendrite Associates, Inc., Hartford, Conn.

[21] Appl. No.: 271,163

[22] Filed: Nov. 14, 1988

Related U.S. Application Data

[63] Continuation-in-part of Ser. No. 53,143, May 21, 1987, abandoned.

[51] Int. Cl.[4] ..... F25C 3/04

[52] U.S. Cl. ..... 62/70; 62/74; 62/347; 239/22

[58] Field of Search ..... 62/69, 70, 74, 347; 239/2.2, 14.2

[56] References Cited

U.S. PATENT DOCUMENTS

| | | | |
|---|---|---|---|
| 2,571,069 | 10/1951 | Shearman | 62/74 X |
| 3,010,660 | 11/1961 | Barrett | 62/74 X |
| 3,301,485 | 1/1967 | Tropeano et al. | 239/2.2 |
| 3,464,625 | 9/1969 | Carlsson | 62/74 X |
| 3,494,559 | 2/1970 | Skinner | 239/14.2 X |
| 3,945,567 | 3/1976 | Rambach | 239/14.2 |
| 3,969,908 | 7/1976 | Lawless et al. | 62/74 |
| 4,004,732 | 1/1977 | Hanson | 239/2.2 |
| 4,214,700 | 7/1980 | Vanderkelen et al. | 239/2.2 |
| 4,223,836 | 9/1980 | Eager | 239/2.2 |

*Primary Examiner*—William E. Tapolcai
*Attorney, Agent, or Firm*—Hayes & Reinsmith

[57] ABSTRACT

A process and apparatus for producing snow which provide a stream of pressurized air and pressurized water; combine the air stream and the water stream to cool the water and provide a first stream of a mixture of the air and water; thereafter aspirate a portion of the air in a counter-flow direction from air into the first stream and mixing therewith, to form a second stream of a mixture of air and water, the second stream being coaxial with the first stream; and disperse the second stream into freezing temperature atmosphere to freeze the water in the second stream and produce snow. In the preferred embodiment, a central stream of water of pressure of at least 300 psig is combined with air of pressure no more than about 30 psig coaxially combined and creating the first mixture. Ice crystals are utilized as a nucleating agent to promote the freezing of water in the second stream.

19 Claims, 7 Drawing Sheets

SNOWMAKING PROCESS AND APPARATUS

BACKGROUND OF THE INVENTION

This application is a continuation-in-part of U.S. patent application Ser. No. 053,143 filed May 21, 1987, now abandoned.

The present invention relates to methods and apparatus for making snow and, in particular, to methods and apparatus for making snow using relatively low pressure compressed air.

Snowmaking methods and apparatus generally have been classified into two distinct groups, the so called "air" and "airless" types. The former utilizes compressed or pressurized air, usually at relatively high air pressures, to break water up into droplets and disperse the droplets into freezing temperature air. The latter does not use compressed air but instead uses a fan to disperse water droplets into the air to produce snow. Typical "air" and "airless" snowmaking devices are disclosed in U.S. Pat. Nos. 2,676,471 and 2,968,164, respectively.

Because of differences in the control of water droplet break up, propulsion, and ice nuclei generation, the air and airless snowmaking devices have different operating characteristics at different atmospheric temperatures. The airless-type devices typically excel at lower temperatures, i.e., less than about 24° F.

The air-type snowmaking devices have operational advantages at temperatures near the freezing point of water but are at a disadvantage at lower temperatures, however, because their generally fixed mixing throat size limits the amount of air which may be mixed with the water. In addition, these air devices are at a disadvantage in field use because of the relatively high air pressures—up to 100 psig or more—which are necessary to break up the water droplets to a sufficient degree. The use of high pressure air is quite costly and inefficient in snowmaking.

Bearing in mind these and other deficiencies of the prior art, it is a primary object of the present invention to provide a method and apparatus for snowmaking which is highly efficient over a wide range of temperatures, particularly at high effective snow making temperatures.

It is another object of the present invention to provide a method and apparatus for snowmaking which utilizes lower compressed air pressures.

It is a further object of the present invention to provide a snowmaking apparatus and method which retains maximum control over operating parameters.

It is yet another object of the present invention to provide a snowmaking apparatus and method which provides maximum cooling and momentum transfer during water droplet formation.

It is yet another object of this invention to provide snowmaking apparatus of the air-type wherein mixing of the water and air takes place in two stages.

It is a further object of the present invention to provide a snowmaking apparatus and method which more efficiently employs compressed air.

It is still a further object of the invention to provide snowmaking apparatus of the low air pressure type wherein reverse jet pumping action is used to effect superior air/water mixing.

An important object of the invention is to provide snowmaking apparatus that operates at reduced noise levels to reduce operator risk while improving the ability to use in residential areas.

Other objects will be in part obvious and in part pointed out in more detail hereinafter.

A better understanding of the objects, advantages, features, properties and relations of the invention will be obtained from the following detailed description and accompanying drawing which set forth an illustrative embodiment and is indicative of the way in which the principle of the invention is employed.

SUMMARY OF THE INVENTION

In one aspect, the present invention provides a process for producing snow comprising providing a stream of pressurized air at low pressures in the general range of 30 psi; providing a stream of pressurized water; combining the air stream and the water stream to provide a first stream of a mixture of the air and water; thereafter aspirating a portion of air from a source of ambient temperature air into the first stream and mixing therewith, to form a second stream of a mixture of air and water; and dispersing the second stream into the atmosphere to freeze the water and produce snow. In a preferred embodiment, the process utilizes a central stream of water of inlet pressure of at least 300 psig and a surrounding annular stream of air of pressure of about 30 psig to coaxially combine and create the first mixture with the higher velocity air stream coupling with and transferring velocity to the stream of waters. The low pressure, freezing temperature ambient air is preferably no more than about 4–6 psig pressure, and, more preferably, is at atmospheric pressure.

In another aspect, the present invention provides an apparatus for producing snow comprising first passageway means for connection to a source of pressurized air to provide a stream of air; second passageway means for connection to a source of pressurized water to provide a stream of water; mixing means connected to the first and second passageways for combining the air stream and the water stream to provide a first stream of mixture of the air and water; means connected to the mixing means for aspirating a portion of air from a source of low pressure ambient temperature air into the first stream and mixing therewith, to form a second stream of a mixture of air and water, and means for dispersing the second stream into freezing temperature atmosphere to freeze the water in the second stream and produce snow. In the preferred embodiment of the apparatus, the second passageway for water is generally centrally located and includes an adjustable exit orifice for the water, the first passageway is annular and surrounds the second passageway and the mixing means coaxially combines the air and water streams.

In a further aspect, the present invention utilizes a nucleating agent to promote the freezing of the water in the second stream, and a nucleating device for adding the ice crystals to the second stream which includes a central water passageway having an adjustable exit orifice for providing a stream of pressurized water and an annular air passageway surrounding the water passageway to provide an annular stream of pressurized air to mix with and cool the water sufficiently to produce the nucleating ice crystals.

DETAILED DESCRIPTION OF THE INVENTION

Figure 1:
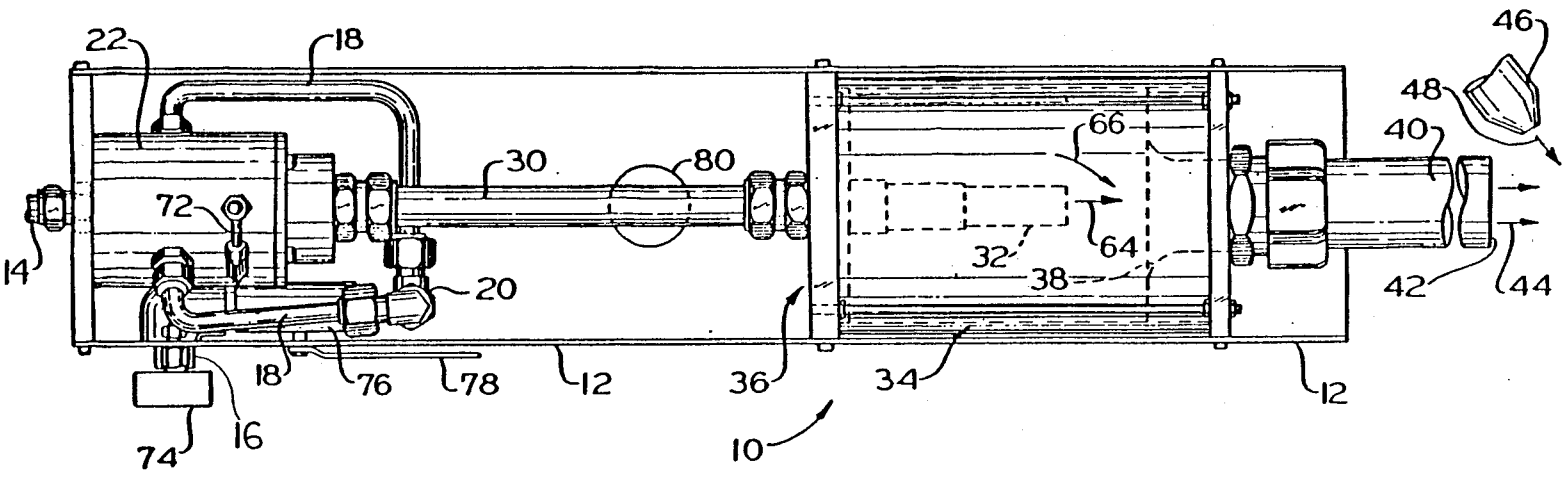
FIG. 1 is a top view of the snowmaking apparatus of the present invention with the housing cover removed.
Figure 2:
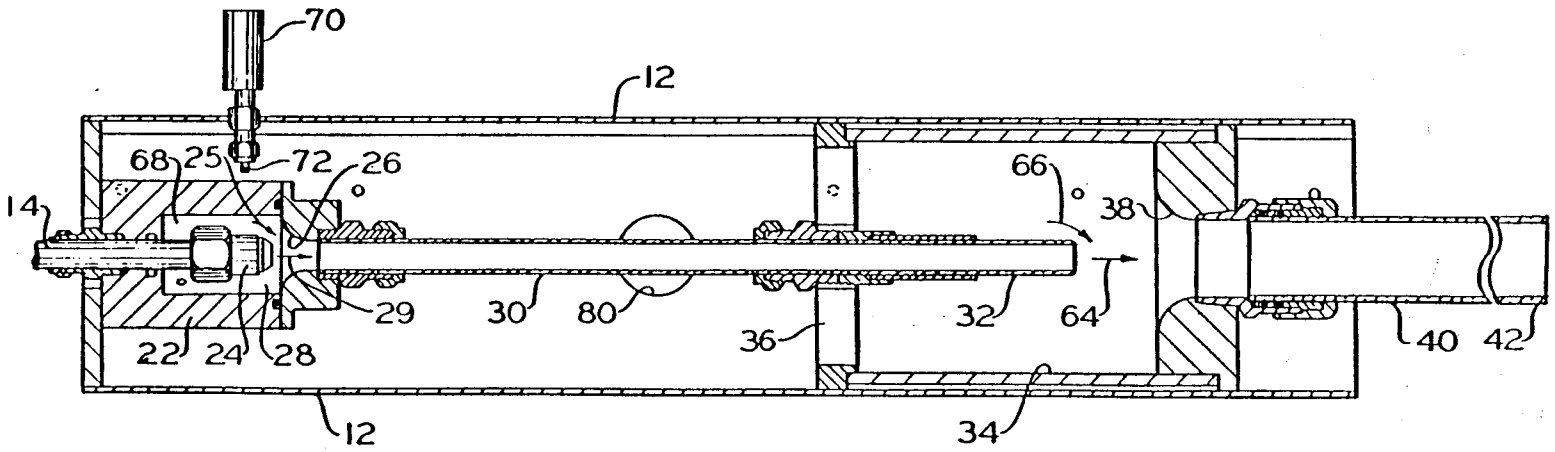
FIG. 2 is a longitudinal sectional side view of the embodiment of FIG. 1.

A principal embodiment of the snowmaking apparatus 10 of the present invention is shown in FIGS. 1 and 2. As shown more clearly in FIG. 1, apparatus housing 12 contains water inlet 14 for pressurized water and an air fitting 16 which may be connected to a source of pressurized or compressed air. Water inlet 14 leads directly into the first stage mixing body 22 of the apparatus. Air inlet fitting 16 is connected by conduits to a valve 76 having a handle 78 thereon for adjusting the flow of pressurized air. Beyond ball 76 is a tee-fitting 20 which supplies two branches of air conduit 18 which each connect and lead into the generally cylindrical first stage mixing body 22 on opposite sides thereof. An air pressure gauge 74 reads air pressure at inlet fitting 16.

To create a stream of pressurized water to initiate the production of snow, water inlet 14 is connected to a source of pressurized water (not shown) and leads into cylindrical chamber 68 (FIG. 2) within first stage mixing body 22 where it terminates in a suitable valve 24. Valve 24 is shown as a needle valve aimed to eject a stream of water in the direction of arrow 29 through the first stage mixing body throat 26 and coaxially into first stage mixing tube 30.

Figure 3:
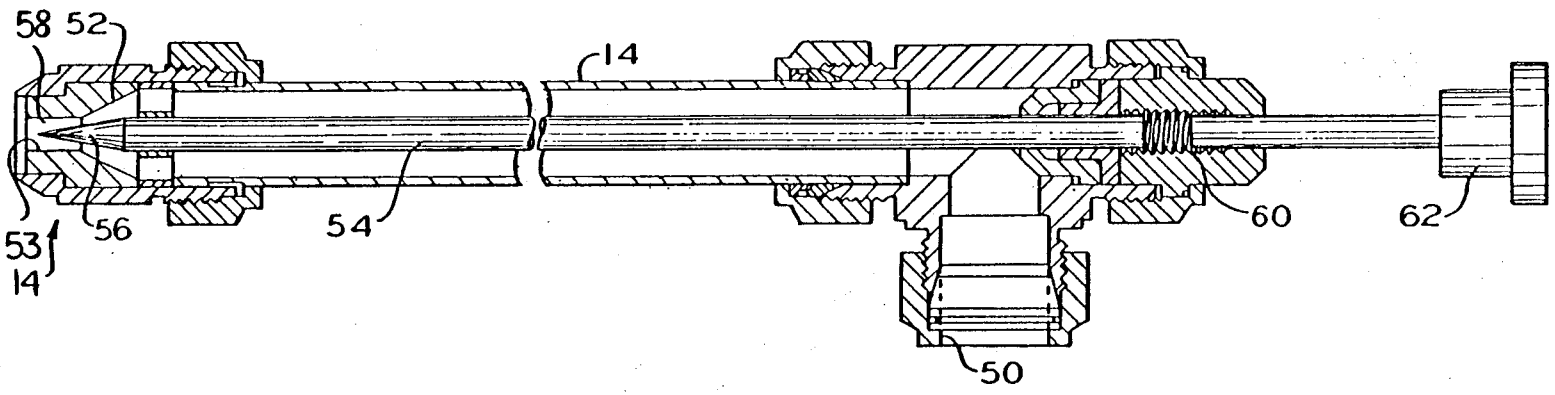
FIG. 3 is a longitudinal sectional side view of the needle valve assembly utilized in the embodiment of FIG. 1.

As shown more clearly in FIG. 3, water inlet 14 comprises a straight tube having an external water inlet fitting 50 and an external adjustment knob 62 to control the flow of water therethrough. Needle valve 24 includes at the tube exit a conical shaped throat 52 which converges to a circular orifice 53 and through which protrudes a coaxial needle shaft 54 which terminates in a needle point 56. Shaft 54 includes a threaded portion 60 and is longitudinally adjustable by rotation of attached adjustment knob 62 to move needle point 56 into and out of the needle valve throat 52 and orifice 53. The movement of needle point 56 out of and into orifice 53 respectively enlarges and contracts the area of annular opening 58 through which the high velocity stream of pressurized water particles emerges. This type of valve having a continuously adjustable and variable annular water exit is preferred for use in the first stage of the snowmaking apparatus of the present invention since the water flow rate therethrough may be easily controlled without significantly affecting water pressure and momentum. This preferred valve is contrasted with other types which control water flow by decreasing water pressure upstream of the exit orifice, e.g., ball and gate valves. As will be seen, the conservation of water momentum in the practice of the present invention process is important in achieving high efficiency snowmaking.

Turning back to FIGS. 1 and 2, pressurized air from conduit 18 is received on opposite sides into first stage mixing body chamber 68. A coaxial annular opening 28 formed around needle valve 24 provides an annular air stream flow in the direction indicated by arrow 25 as it passes through and out of first stage mixing body 22. Smooth converging throat 26 causes the air stream 25 to converge at a relatively shallow angle and mix with water stream 29 being emitted from needle valve 24. A straight first stage mixing tube 30 is connected to the exit end of first stage body throat 26 and is coaxially aligned with both needle valve 24 and annular air opening 28. Mixing tube 30 extends away from first stage mixing body 22. A preferred length to inner diameter ratio of mixing tube 30 is approximately 20 to 1. Known fluid engineering techniques have shown that liquid-jet gas pumps have an optimum diameter to length ratio to effect mixing of the air and water into a bubbly or frothy air-water mix. The use of such techniques in snowmaking apparatus are believed novel and are a principal feature of the primary embodiment of this invention. By this invention, applicants use technology which permits the pressurized air to accelerate and cool the water.

In accordance with one aspect of this invention and to provide for further cooling and mixing of the first mixed stream of air and water ejected from the end 32 of first mixing tube 30, as shown by arrow 64, there is provided a second stage mixing body 34 surrounding first stage mixing tube end 32. Annular open end 36 of second stage body 34 permits low pressure freezing temperature air to be supplied to the interior of body 34. Where ambient atmospheric air is used as a source of low pressure air in the second stage mixing, housing 12 may contain openings 80 which permit entry therethrough for ambient air into second stage mixing body 36. Coaxial with mixing tube 30 and at the end opposite opening 36 is the converging smooth throat 38 of the second mixing body 34 which receives the first air/water mixture 64 ejected from mixing tube end 32. The passage of the first stream 64 through the interior of body 34 and into throat 38 causes the low pressure air to be aspirated in the direction 66 into the first stream.

As shown in this embodiment, the distance between the first stage mixing tube end 32 and the beginning of second stage throat 38 is approximately 2–3 diameters of mixing tube 30. This separation distance may be changed to vary the amount of air aspirated.

Second stage mixing body throat 38 leads to a straight second stage mixing tube 40 which is coaxially aligned with throat 38 and first stage mixing tube 30. Second stage mixing tube 40 has a considerably greater axial cross sectional area than first stage mixing tube 30 to accomodate the extra flow of air aspirated in the second stage air/water mixture. Second stage mixing tube 40 terminates at tube end 42 through which the second mixture of air and water is ejected into the atmosphere. In the preferred embodiment as shown in FIGS. 1 and 2, the length to diameter of ratio of second mixing tube 40 is approximately 8 to 1.

To provide for the introduction of additional ice nuclei into the stream of air and water indicated by arrows 44 there is provided a nucleator 46 gun (FIG. 1) which produces a stream of ice nuclei in the direction indicated by 48 which combines with the stream 44. This nucleator 46 may be of any suitable design.

The operation of the snowmaking apparatus shown in FIGS. 1, 2, and 3 is as follows:

A source of water having a pressure of at least 300 psig or more is attached to water inlet 14 through fitting 50 which supplies water to the snowmaking apparatus. A source of compressed air, preferably up to about 30 psig, and, more preferably from about 20 to 25 psig, is connected by a fitting 16 to the apparatus 10. Pressurized water is emitted from needle valve 24 in the direction 29 and is mixed with the annular stream of pressurized air in direction 25 as the air and water pass into first stage throat 26. The air stream 25 is preferably greater velocity than that of the water stream 29. In one test, air at a velocity of approximately 800 feet per second was mixed with water at approximately 13 feet per second thereby accelerating and cooling the mixture. The expansion of the pressurized air as it combines with the water ejected from the needle valve acts to produce a confined frothy or bubbly mixture of air and water as this first mixture flows through first stage mixing tube 30. In addition to producing this bubbly mixture the expansion of the pressurized air also acts to further cool the water.

The flow of the bubbly first air/water mixture through first stage mixing tube 30 should be sufficient to form water droplets and/or bubbles of air suspended in water. The length to diameter ratio of the first stage mixing tube in which this first mixture of air and water is confined is preferably from about 10:1 to about 40:1, with the higher ratios needed to complete mixing to a greater extent. Use of such a long mixing tube to create a frothy, bubbly mixture of low pressure air with high pressure water is believed to be uniquely novel in snowmaking apparatus.

It has been found that a second stage of the apparatus enhances snowmaking operation at higher ambient temperatures. As the first mixture of air and water is ejected from the end 32 of first stage mixing tube 30 it is exposed to and passes through low pressure ambient temperature air (usually less than or equal to 32° F.) in a second stage. The air in the second stage is initially at a pressure lower than that provided for the pressurized air used in the first stage. As used herein, the term "low pressure air" includes atmospheric pressure (0 psig) air. In the preferred embodiment shown in FIGS. 1 and 2, atmospheric pressure air at ambient freezing temperature is provided from the surrounding environment through opening 80 in housing 12 and open end 36 in second mixing chamber 34. The ejection of the first mixture of air and water from tube end 32 and into second mixing throat 38 provides a "jet pumping" effect wherein the second stage low pressure air is aspirated into and mixed with this first mixture of air and water. The smooth contours of second stage throat 38 provides for smooth mixture of the second stage low pressure air and the first mixture of air and water to form a second mixture of air and water which passes through in second stage mixing tube 40. This second stage mixture of air and water will be at a lower pressure than the first stage mixture because of the expansion of the pressurized air in the first stage and addition of low pressure air in the second stage.

The combination of continued expansion of the first stage mixture pressurized air and the aspiration of the low pressure freezing temperature ambient air cools the second air/water mixture to a lower temperature than the first mixture and further enhances the formation of water droplets therein. The conditions in this second stage may be such that ice nuclei may form from these water droplets. The larger cross sectional area of the second stage mixing tube 40 accomodates the added volume of air added in the second stage mixture. The preferable length to inner diameter ratio during this second stage confinement in the mixing tube is approximately 8 to 1, which is generally sufficient length to complete mixing but not so long as to incur unacceptable friction losses.

As the second mixture is ejected from the snowmaking apparatus 10 through second mixing tube end 42 in direction 44, ice nuclei are added in direction 48 from nucleator 46. These ice nuclei add to whatever ice nuclei may already be present in the ejected second mixture provide seeding for the freezing of substantially all the water droplets in the ejected mixture 44. The angle of the stream of ice crystals with respect to the ejected second mixture from snow gun 10 has not been found to be critical to the production of snow.

While most of the typical nucleators that can be used with this invention, use considerably higher pressure air than the snowmaking apparatus 10 of the present invention, it will use only a small fraction of the amount of air used in the air gun 10 and, consequently, will not greatly impact the efficiency of the present invention.

As can be seen from the aforedescribed operation of the present invention, relatively low pressure compressed air is used only for producing ice nuclei and for the initial ventilation and distribution of frozen water droplets. This results in greater efficiency and lower cost in the produce and distribution of such low pressure compressed air at field installations. The high pressure water is used to produce a wide distribution of water droplet sizes and to induce a flow of cool ambient air in which to mix the ice nuclei and water droplets for initial freezing. After a suitable cooling duration in the second stage and after ejection from the snowmaking gun, a two dimensional or axisymmetric plume may be produced for the subsequent evaporative and convective freezing of the water droplets.

The careful coupling of the expansion of the compressed air stream and ejection of the water stream in the first stage coaxial mixing permits maximum work to be extracted from the compressed air, thereby achieving maximum local and initial cooling together with the greatest momentum transfer to the water droplets. The present invention utilizes compressed air in the first stage at a relatively low pressure, but one which is consistent with achieving a significant initial cooling effect and momentum transfer to the water droplets. The formation of a bubbly mixture in the first stage mixing tube is a novel feature of this apparatus, it can be followed by further expansion in a second stage where aspiration of low pressure freezing temperature air provides a low temperature bath in which the water droplets are cooled quickly below 32° F. In addition, the coaxial alignment of air and water mixing in both first and second stages and through to the ejection from the snowmaking apparatus result in maximum momentum conservation and minimum energy loss due to direction changes of the constituent air and water.

Figure 4:
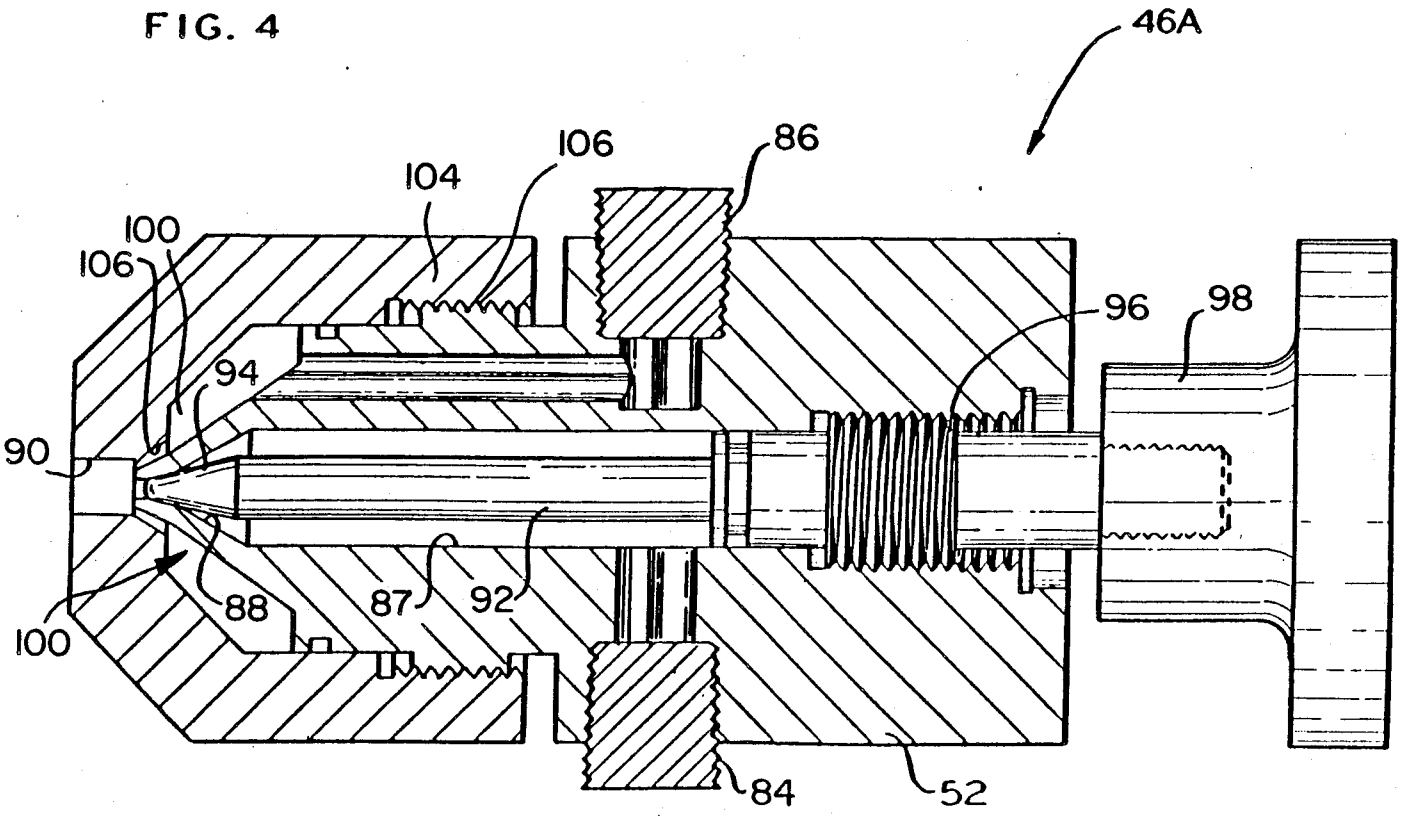
FIG. 4 is a longitudinal sectional side view of a nucleator gun which may be used in the snowmaking apparatus of the present invention.
Figure 5:
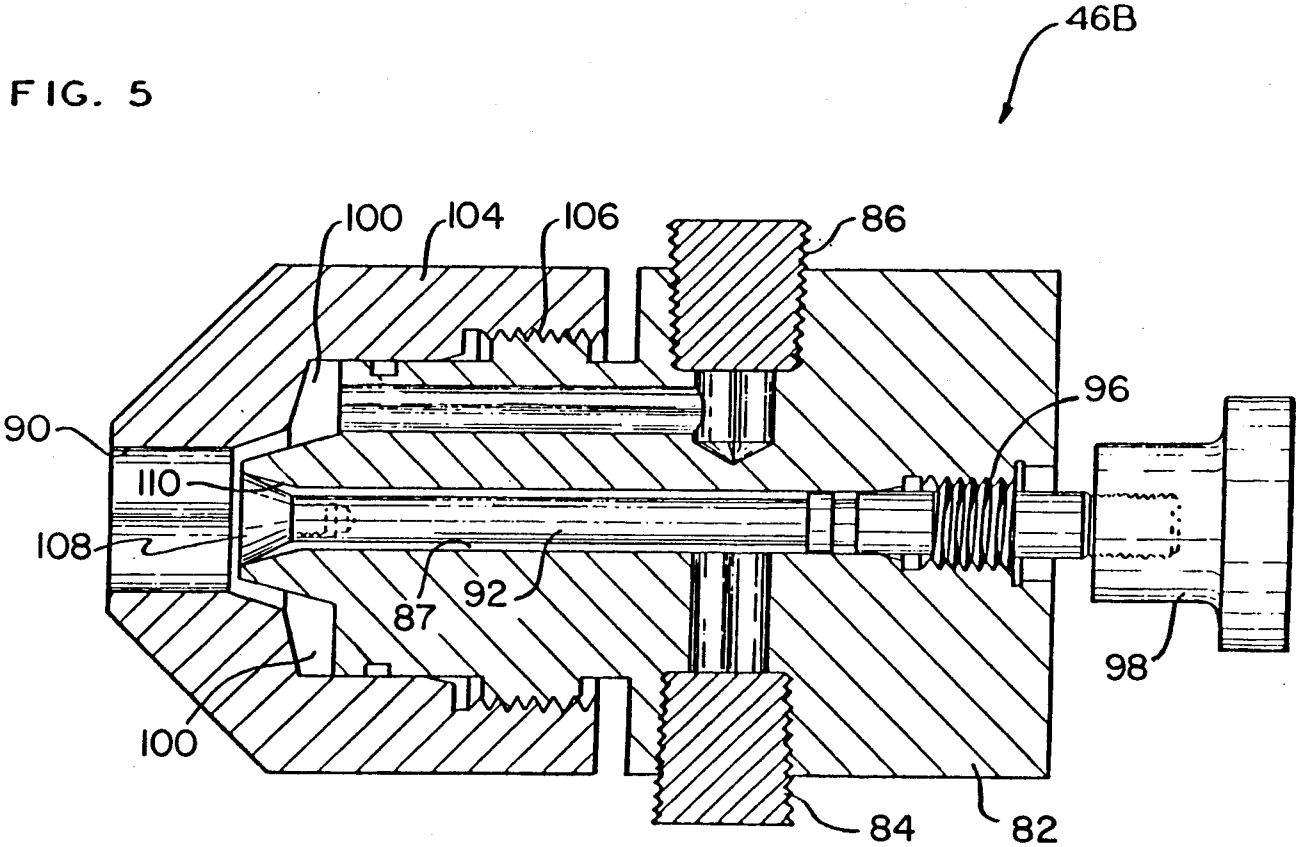
FIG. 5 is a longitudinal sectional side view of another nucleator gun which may be used in the snowmaking apparatus of the present invention.

Two suitable embodiments of nucleator 46 are shown in FIGS. 4 and 5. In FIG. 4 there is shown a first nucleator gun **46*a* which comprises a body 52 into which are connected water and air fittings 84 and 86, respectively. Water fitting 84 leads to a central bore 86 which converges in a conical throat 88 and terminates in a circular water exit orifice 90. A needle value controls the flow of water through orifice 90 and comprises a needle valve shaft 92 which terminates in a conical tip 94 extending into converging throat 88. Needle valve shaft 92 is longitudinally movable within bore 86 along threaded region 96 by rotation of attached adjustment knob 98 to vary the area of the opening between tip 94 and throat 88** and control the flow of water therethrough.

Pressurized air is supplied to nucleator 46*a* through air fitting 86 which leads to an annular chamber 100 which surrounds the outer conical shaped surface 102 of the needle valve throat 88 and orifice 90. A nucleator head 104 is longitudinally adjustable relative to nucleator body 82 by rotation along threads 106. The exit orifice of nucleator head 104 includes a converging conical shaped surface 106 which is complimentary to the outer conical surface 102 of the water needle valve and provides a continuously adjustable annular opening surrounding water exit or orifice 90 for passage of pressurized air.

The pressurized air, which is at normal pressure of about 80 to 120 psig, forms an annular stream which coaxially converges on and mixes with a central water stream emerging through water orifice 90. This high pressure annular air stream breaks up the water stream into water droplets, and, by the expansion of the air, cools the water droplets to form ice crystals. These ice crystals may be then utilized to seed the air water mixture emerging from snowmaking apparatus 10 to form snow.

In the second preferred embodiment as shown in FIG. 5, nucleator 46*b* comprises a similar body 82 and water and air inlets 84 and 86, respectively. A needle valve shaft 92, which is also longitudinally adjustable in central bore 86 by rotation of adjustment knob 98, terminates in a diverging conical shaped member 108 which corresponds to a diverging conical shaped orifice 110 in valve body 82 and forms an adjustable annular opening therebetween. The stream of water which exits orifice 110 is annular and diverging.

An annular stream of high pressure air is provided by flow of the air through the continuously adjustable area of annular passageway 100 between the converging conical shaped outer surface 116 surrounding water orifice 110 and the surrounding converging conical shaped inner surface 114 of adjustable air head 104.

Unlike the first nucleating embodiment, this second embodiment provides a central annular diverging water stream to mix with the surrounding converging annular pressurized air stream to break-up the water droplets and provide cooling to freeze the water droplets into ice nuclei. However, both embodiments provide for efficient coaxial mixing of a central water stream with a surrounding annular air stream to provide maximum cooling and mixing of air and water with a minimum of loss of momentum to either the air or water. Momentum is further conserved by the use of the continuously variable annular opening at the water exit orifice which controls water flow without significantly reducing water pressure upstream of water exit orifice.

Figure 6:
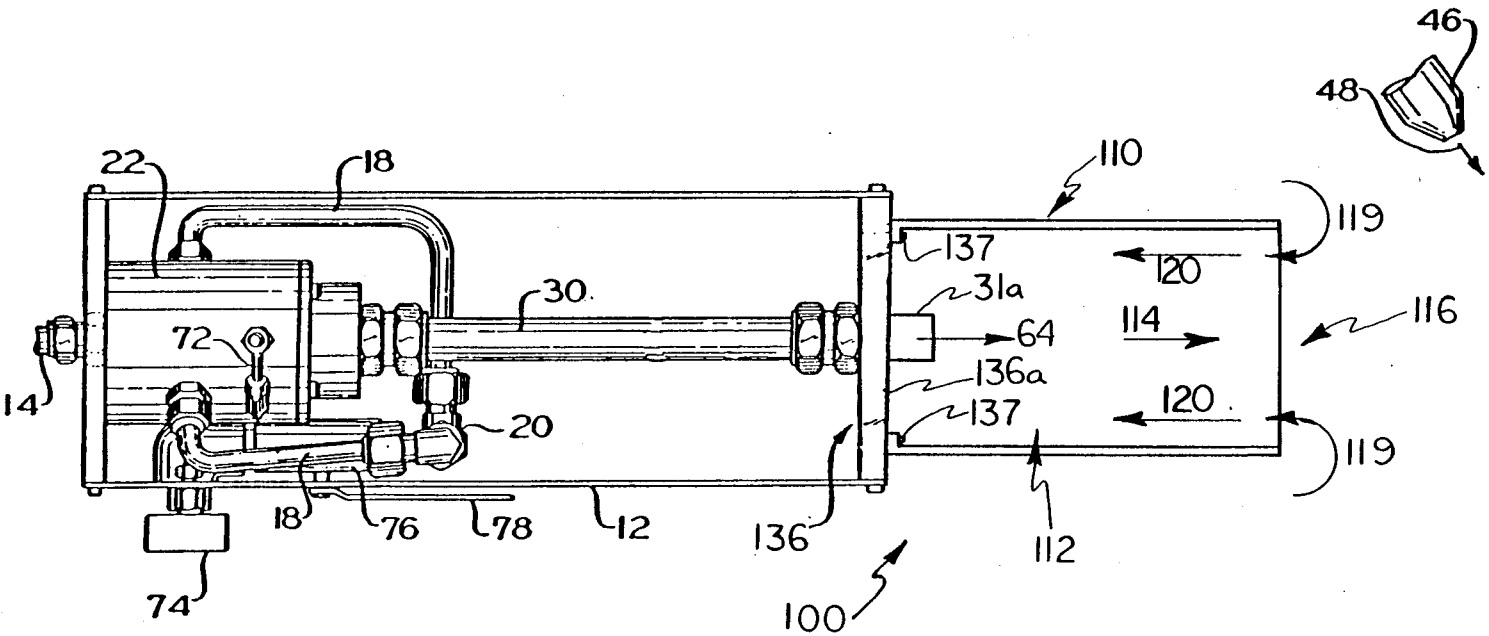
FIG. 6 is a view of an alternative embodiment of the invention shown in FIG. 1.

Turning next to the embodiment of the invention shown in FIG. 6 it will be seen that the first stage of the snowmaking apparatus 100 of FIG. 6 is virtually identical to FIG. 1; hence, the same identifying numbers are used in FIG. 6.

The alternative embodiment of FIG. 6 discloses a second stage 110 comprising a generally cylindrical member or exit tube 112 secured to a solid mounting plate 136 by any suitable fasteners 137 through which mixing tube 30 protrudes by a small distance 31*a*; if desired mixing tube 30 can terminate at the linear face 136*a* of plate 136 which, in effect, merely closes cylinder 110. Frothy mixture 64 is further mixed with ambient air by counter-flow aspiration.

As the frothy mixture 64 moves in the direction of arrow 114, air within tube 112 is entrained and mixed thereby reducing pressure adjacent the exit end of tube 30 and drawing ambient air around the exit end 116 of cylinder 112 and along the inner face thereof (as shown by the arrows 119 and 120) in a direction opposite to the main flow 114. Such counterflow aspiration of ambient air offers the advantage of simplification of structure while providing improved snowmaking with low pressure air supplied to the first stage as well as improved operation of the apparatus in relatively high ambient air conditions. Experimental results confirm such improved snowmaking at temperatures at or near 32° F. while using 30 psi air! Such experimentation has indicated that length to diameter ratio for the exit tube ranges in the 3 to 1 magnitude for good operation of the second stage using counterflow operation.

Experimentation has also shown that the "closed cylinder" second stage can utilize the counter-aspiration effect to add water, at atmospheric pressure, to the output of the mixing tube 30 at a variety of ambient temperatures.

Figure 7:
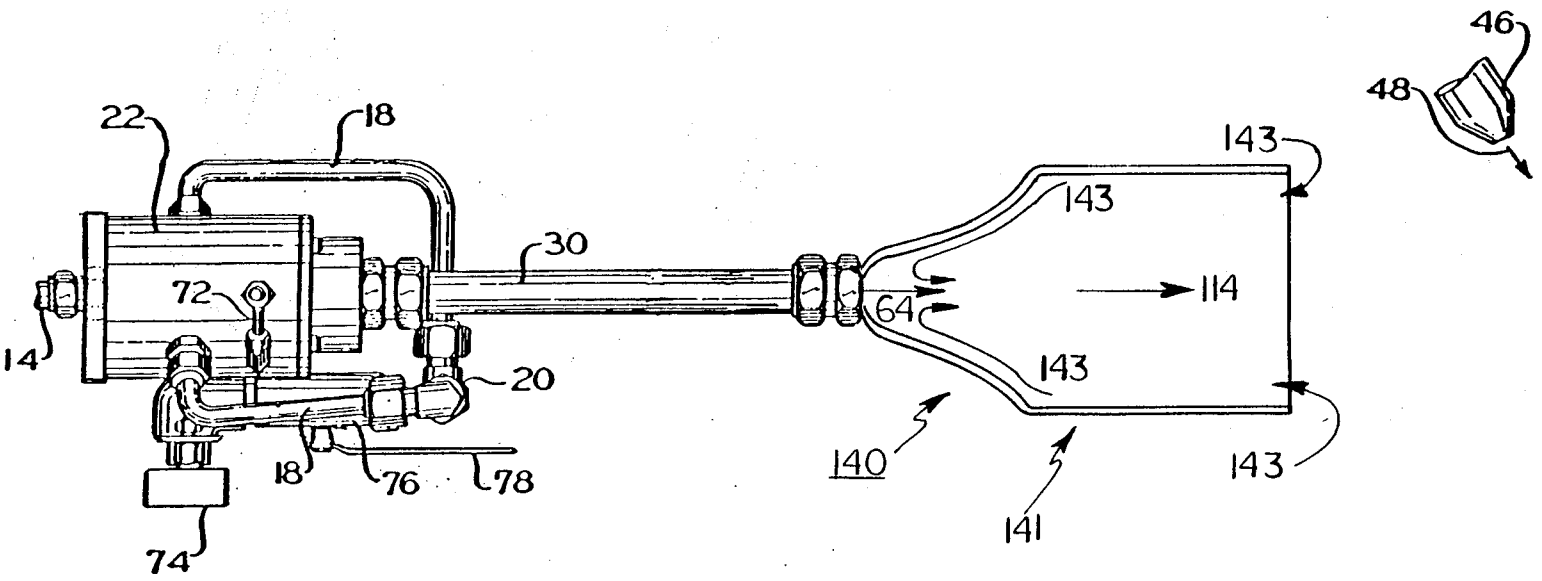
FIG. 7 is a view of a modified embodiment of the invention shown in FIG. 6.

Further experimentation has demonstrated that the shape of the second stage exit tube can also be modified. As seen in FIG. 7, where all external housing structure is removed and similar common numbers for common parts have been used, the second stage of apparatus 140 is merely affixed to the end of the first stage tube 30, the closed cylinder 112 of FIG. 6 can be replaced by a modified bell-shaped structure 141 for the second stage of the apparatus with the small end of the bell affixed to first stage tube 30.

Counterflow aspiration as shown by arrows 143 continues, the higher temperature operation of the apparatus is improved and some air-flow efficiencies are achieved according to test data.

The ratio of length to diameter for the second stage can be modified somewhat but a preferred ratio seems to be approximately 3 to 1.

Improved operation of a snowmaking gun at marginal temperatures near 32° F. can serve to lengthen a ski resort season. Operation of such apparatus at low air pressures which vastly reduce energy cost for the distribution of air on a multiple trail ski resort mountain can be of very great economic value to operators of ski resorts in areas that experience wide ambient temperature fluctuation.

As will be apparent to persons skilled in the art, various modifications, adaptations and variations of the foregoing specific disclosure can be made without departing from the spirit and scope of this invention.

Having thus described the invention, what is claimed is:

1. Apparatus for producing snow comprising:

an elongated, generally cylindrical closed mixing tube having inlet and outlet ends, means for introducing high pressure water into said inlet end of said mixing tube coaxial therewith, means for introducing air at a pressure lower than the water pressure but above atmospheric pressure into the inlet end of said mixing tube in a direction and location coaxial with said mixing tube, said water and air being mixed in said tube as the mixture moves along the length of said cylindrical mixing tube, said tube having a length to diameter ratio in the range of 10:1 to about 40:1, said water and air being mixed to form a bubbly, frothy mixture that is ejected into the atmosphere.

2. The apparatus of claim 1 wherein a mixing device is affixed at the inlet end of said mixing tube for directing the water along the central axis of said tube and for directing the air coaxial to the water.

3. The apparatus of claim 1 wherein said air stream is provided from a source of compressed air no greater than 30 psig.

4. Apparatus for producing snow comprising:

first elongated cylindrical passageway, a source of pressurized water, means for connecting an end of said passageway to said source of pressurized water to provide a stream of water therethrough directed along the central axis of said cylindrical passageway, a source of pressurized air of lower pressure than said water pressure, means for connecting said cylindrical passageway to said air source of lower pressure than the water source to provide a stream of air coaxial to and surrounding the stream of water in said cylindrical passageway;

said elongated passageway being a mixing tube having a length substantially greater that its diameter whereby said air stream and said water stream are combined to cool said water and provide a stream of the mixed air and water, and a second stage member having a cylindrical exit coaxial with the said passageway and affixed at the exit end thereof.

5. The apparatus of claim 2 wherein said mixing device includes a valve having an adjustable exit orifice for controlling said stream of water.

6. The apparatus of claim 5 wherein air is combined in said mixing device along an annular passageway coaxial with and surrounding axis of the stream of water in said tube.

7. The apparatus of claim 1 including a second stage member having a generally cylindrical portion, means affixing said second stage member to the outlet of said mixing tube, said second stage member having its exit diameter greater than the exit diameter of said mixing tube and its input end affixed in a generally sealed manner to the exit of the mixing tube whereby counterflow aspiration takes place to draw air or water along the interior wall of the second stage member to thereafter mix with the output of the mixing tube and be discharged from the exit end of said second stage member.

8. The apparatus of claims 7 wherein said second stage member is contoured in cross-section from the cylindrical exit end to the input end affixed to the mixing tube.

9. The apparatus of claim 8 wherein the wall of the second stage member is imperforate.

10. The apparatus of claim 7 wherein the wall of the second stage member is imperforate.

11. The apparatus of claim 9 wherein the exit of said second member is coaxial with the exit of said mixing tube to provide uninterupted passage for the water-air mix therethrough.

12. The apparatus of claim 10 wherein the exit of said second member is coaxial with the exit of said mixing tube to provide uninterupted passage for the water air mix therethrough.

13. The apparatus of claim 11 wherein means are provided for adding ice as a nucleating agent to the outlet stream from said second member, said means including a central water passageway having an adjustable exit orifice for providing a stream of pressurized water and an annular air passageway surrounding said water passageway for providing an annular stream of pressurized air to mix with and cool said water to produce said nucleating ice crystals.

14. The apparatus of claim 13 wherein said water exit orifice includes means for producing a converging water stream.

15. The apparatus of claim 13 wherein said water exit orifice includes means for producing a diverging water stream.

16. A process for producing snow comprising the steps of:

(a) directing a stream of pressurized water into a cylindrical mixing tube along the central cylindrical axis;

(b) directing a stream of pressurized air into the cylindrical mixing tube coaxial with the cylindrical axis so as to surround the water stream;

(c) combining said air stream and said water stream to cool said water and provide a first stream of a mixture of said air and water in said tube;

(d) thereafter aspirating in a direction opposite to stream flow a portion of air from ambient air into said first stream and mixing therewith to form a second stream of a mixture of air and water, said second stream being coaxial with said first stream; and (e) dispersing said second stream into freezing temperature atmosphere to freeze the water in said second stream and produce snow.

17. The process of claim 16 wherein said air stream is an annular stream and wherein said combining step is initially by surrounding said water stream with said annular air stream.

18. The process of claim 16 wherein said air stream is provided from a source of compressed air having a pressure no greater that about 30 psig.

19. The process of claim 16 wherein the counter flow aspirating is by directing said first stream through and into a larger second stage tube to create a jet pumping effect.

* * * * *